United States Patent [19]

Duda

[11] Patent Number: 4,607,654

[45] Date of Patent: Aug. 26, 1986

[54] AWNING LATCH ASSEMBLY

[75] Inventor: Henry J. Duda, Mount Prospect, Ill.

[73] Assignee: Randall Equipment Company, Mt. Prospect, Ill.

[21] Appl. No.: 697,477

[22] Filed: Feb. 1, 1985

[51] Int. Cl.[4] ..... E04H 15/08; E04F 10/06; G05G 5/06; B65H 75/48

[52] U.S. Cl. ..... 135/89; 135/903; 135/DIG. 9; 160/73; 160/300; 74/527; 74/530; 74/97; 242/107.12

[58] Field of Search ..... 135/88, 89, 120, 903, 135/904, DIG. 5, DIG. 9; 160/45, 46, 50, 51, 52, 54, 55, 56, 66, 73, 291, 294, 300, 303, 304 A; 74/527, 533, 530, 540, 97; 296/98, 101, 141, 143; 242/97, 107.6, 107.4 R, 107.12, 107.4 B, 107.4 C, 107.4 D, 107.4 E

[56] References Cited

U.S. PATENT DOCUMENTS

| | | | |
|---|---|---|---|
| 583,830 | 6/1897 | Wiley | 242/107.6 |
| 1,133,511 | 3/1915 | Stutler | 242/107.6 |
| 1,806,549 | 5/1931 | Wallace | 242/99 |
| 2,249,114 | 7/1941 | Coffman | 242/107.6 |
| 2,761,029 | 8/1956 | Peabody | 74/97 |
| 2,788,791 | 4/1957 | Pospisil et al. | 135/109 |
| 2,889,840 | 6/1959 | McIlwaine | 135/101 |
| 2,920,501 | 1/1960 | Couch | 74/530 |
| 3,324,869 | 6/1967 | Duda | 135/89 |
| 3,612,145 | 10/1971 | Darula | 135/89 X |
| 3,779,302 | 12/1973 | Akers et al. | 135/89 X |
| 3,826,271 | 6/1974 | Sattler et al. | 135/89 |
| 3,897,024 | 7/1975 | Takada et al. | 242/107.4 B |
| 3,918,510 | 11/1975 | Hayward | 160/45 |
| 4,089,230 | 5/1978 | Nelson | 74/97 |
| 4,117,876 | 10/1978 | Bennett | 167/67 |
| 4,125,142 | 11/1978 | Föhl | 160/300 X |
| 4,195,877 | 4/1980 | Duda | 296/172 |
| 4,262,955 | 4/1981 | Duda | 296/24 R |

FOREIGN PATENT DOCUMENTS

| | | | |
|---|---|---|---|
| 17930 | 2/1930 | Australia | 160/73 |

*Primary Examiner*—Robert A. Hafer
*Assistant Examiner*—D. Neal Muir
*Attorney, Agent, or Firm*—Emrich & Dithmar

[57] ABSTRACT

An awning assembly for a travel trailer or a mobile home which includes a flexible awning covering wound on a roller which is rotatable on a fixed shaft carried by a supporting frame, includes a latch apparatus comprising a cylindrical end plate rotatable with the roller and closing one end thereof, and a cap disposed adjacent to the end plate and fixed to the frame and the shaft. The end plate has a cylindrical portion coaxial with the shaft which projects toward the cap and defines a cavity having a plurality of equiangularly spaced-apart keeper recesses around the perimeter thereof. A latch handle pivots on the cap about an axis parallel to the shaft and carries a latch pin which extends parallel to the shaft for movement with the handle between a latching position disposed in one of the keeper recesses to latch the roller against rotation and an unlatching position disposed in the cavity but out of the recesses to accommodate free rotation of the roller.

12 Claims, 7 Drawing Figures

AWNING LATCH ASSEMBLY

BACKGROUND OF THE INVENTION

The present invention relates to awnings for travel trailers and/or mobile homes, which awnings may be of the type disclosed in U.S. Pat. No. 3,324,869. In that type of awning assembly, a flexible awning cover is wound on a roller which is rotatable on a shaft, the free end of the awning cover being fixed to the trailer. The roller is carried by pivoting arms which swing toward and away from the mobile home to move the awning between furled and unfurled conditions.

The present invention relates in particular to means for inhibiting rotation of the roller when the awning is in either its furled or unfurled condition. The invention is an improvement of the mechanism disclosed in my copending U.S. application Ser. No. 460,178, filed Jan. 24, 1983, and entitled "Awning Assembly". That application discloses an arrangement wherein the roller is provided with an end plate rotatable therewith, there also being provided a cap affixed to the roller shaft. A stud is threadedly engaged with the cap and can be screwed into engagement with detents and recesses on the end plate to lock the roller against rotation. This is a cumbersome arrangement, since it necessitates extensive manual rotation of the threaded stud to perform the locking and unlocking operations. The inconvenience of this arrangement is aggravated by the fact that the roller and its associated cap are typically located at a considerable elevation above the ground and are, therefore, not easily accessible.

SUMMARY OF THE INVENTION

It is a general object of the present invention to provide an improved awning assembly and latch apparatus therefor which avoid the disadvantages of prior assemblies while affording additional structural and operational advantages.

An important object of the invention is the provision of a latch apparatus which can be easily and quickly shifted between latching and unlatching conditions with a single movement.

In connection with the foregoing object, it is another object of the invention to provide a latch apparatus of the type set forth which facilitates operation from the ground.

Another object of the present invention is the provision of a latch apparatus of the type set forth which is of simple and economical construction.

Yet another object of the invention is the provision of a latch apparatus of the type set forth which is fast-acting and reliable.

It is yet another object of the invention to provide an awning assembly which incorporates a latch apparatus of the type set forth.

These and other objects of the invention are attained by providing latch apparatus for a roller rotatable about an axis, comprising: a first member fixed with respect to the axis, a second member carried by the roller for rotation therewith adjacent to the first member, the second member having a plurality of keeper recesses therein, a latch member carried by the first member for movement between a latching position disposed in the path of the keeper recesses and an unlatching position out of the path of the keeper recesses, the latch member in the latching position thereof being engageable in a selected one of the keeper recesses for inhibiting rotation of the second member and the roller, and bias means resiliently inhibiting movement of the latch member from the latching and unlatching positions thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
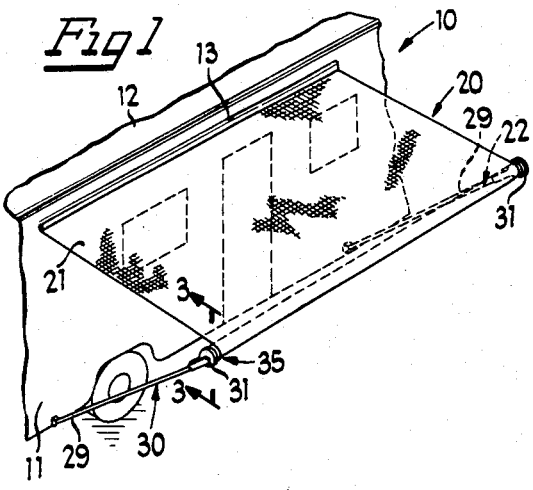
FIG. 1 is a fragmentary perspective view of a travel trailer with an awning assembly incorporating latch assemblies in accordance with the present invention.

Referring to FIG. 1, there is illustrated a vehicle 10, which may be a travel trailer and/or mobile home, which has an exterior side wall 11 and a roof 12. Mounted on the roof 12 adjacent to the side edge thereof and extending substantially horizontally is an elongated awning rail 13 to which is fixedly secured the free end of an awning cover 21 of an awning assembly 20, which may be generally of the type illustrated in the aforementioned U.S. Pat. No. 3,324,869, or in the aforementioned copending U.S. application Ser. No. 460,178.

The awning cover 21 is formed of a flexible fabric which is rolled on an elongated roller 22. More particularly, referring to FIGS. 3 and 6, the roller 22 has a cylindrical body 23 provided at the opposite ends thereof with parallel annular end faces 24, each being counterbored to form a cylindrical inner surface 25 extending axially into the body 23. Respectively received coaxially in the opposite ends of the roller 22 are two coaxial stub shafts 33 (one shown), dimensioned so that the roller 22 is freely rotatable thereon about the axis thereof. While stub shafts 33 are disclosed, it will be appreciated that there alternatively could be provided a single shaft which is disposed in a bore extending axially through the entire length of the roller 22.

The opposite ends of the roller 22 are adapted for attachment, respectively, to parallel support arms 29 of a support frame 30. More specifically, each of the support arms 29 is preferably an assembly of telescoping sections, pivotally connected at one end thereof to the vehicle side wall 11 adjacent to the lower edge thereof. The upper ends of the support arms 29 are respectively fixedly secured to coupling heads 31, each of which has a central cylindrical hub (FIG. 6) 32, as is more specifically explained in the aforementioned U.S. Pat. No. 3,324,869. Received in each hub 32 is one end of a stub shaft 33 (one shown), being held in place by a suitable fastener 34 which extends through aligned radial bores through the hub 32 and the stub shaft 33. The other end of the stub shaft 33 extends coaxially into the adjacent end of the roller 22 for coupling thereto and support thereof, in a manner which will be explained more fully below.

It will be appreciated that the support arms 29 are pivotally movable between a stowed position alongside the vehicle side wall 11, in which position the awning cover 21 is completely furled on the roller 22, and a use position illustrated in FIG. 1, extending outwardly away from the vehicle side wall 11 at a predetermined angle, in which position the awning cover 21 is unfurled from the roller 22, all in a well known manner. If desired, additional stiffening rods (not shown) may be provided along the opposite side edges of the unfurled awning cover 21 between the vehicle side wall 11 and the roller 22 to provide additional support for the awning assembly 20. Preferably, the inner diameter of the hub 32 is substantially greater than the diameter of the stub shaft 33 to provide a relatively loose coupling, thereby permitting considerable tilting movement of the stub shaft 33 with respect to the hub 32. This facilitates furling and unfurling of the awning cover 21, one end at a time, which may be necessary where only a single person is available to operate the awning assembly 20.

At least one end of the roller 22 is provided with a latch assembly 35, constructed in accordance with and embodying the features of the present invention. Referring also to FIGS. 2, 4, 5 and 7, the latch assembly 35 includes a circular end cap 40, which is preferably of unitary one-piece construction, being formed of metal such as anodized aluminum, the end cap 40 having an integral raised portion or boss 39. The end cap 40 has a flat planar annular bearing face 41 on the side thereof opposite the boss 39. Integral with the bearing face 41 centrally thereof and projecting therefrom coaxially therewith is a cylindrical hub portion 42. A cylindrical axial bore 43 extends through the end cap 40, including the boss 39 and the hub portion 42, for receiving therein the adjacent end of the associated stub shaft 33. Extending laterally through the boss 39 is a bore 44 which communicates with the bore 43 radially thereof. The bore 44 may be internally threaded to accept a set screw (not shown), fixedly to secure the end cap 40 on the stub shaft 33. Alternatively, a radial bore 46 may be formed through the stub shaft 33 for alignment with the bore 44 to accept a roll pin 45 or the like, for fixing the stub shaft 33 with respect to the end cap 40. It will be appreciated that the other stub shaft 33 may be similarly fixedly secured to the other support arm 29, so as securely to hold the shafts 33 against rotation.

Integral with the bearing face 41 at the outer periphery thereof and projecting axially therefrom in the same direction as the hub portion 42 is a cylindrical flange 47, having an inner diameter slightly greater than the outer diameter of the roller 22. Formed in the annular bearing face 41 and the flange 47 at the periphery thereof is a part-cylindrical recess 48, which has a depth such that it extends substantially to the level at which the outer surface of the end cap 40 joins the boss 39. Fixedly secured to the bearing face 41 on the opposite side of the hub portion 42 from the recess 48 is a short stud 49 which projects from the bearing face 41 substantially parallel to the axis of the stub shaft 33.

Carried by the end cap 40 is a latch arm, generally designated by the numeral 50. More specifically, the latch arm 50 has a generally circular mounting portion 51 which is receivable in the recess 48 coaxially therewith, the thickness of the mounting portion 51 being such that it is substantially coplanar with the bearing face 41 when mounted in the recess 48. The mounting portion 51 has an axial bore 52 therethrough which is disposed in alignment with a bore **52*a* in the boss 39 of the end cap 40 for receiving a pivot pin 53, about which the latch arm 50 is pivotally movable. Integral with the mounting portion 51 of the latch arm 50 is an actuator handle 54 which is curved so as to lie along and closely follow the outer periphery of the end cap 40 in one position of the latch arm 50. Integral with the actuator handle 54 at its distal end is an eye portion 55**.

Figure 4:
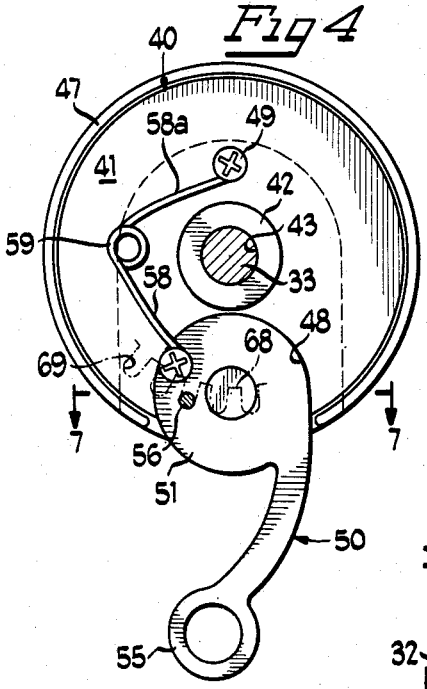
FIG. 4 is a fragmentary view in vertical section taken along the line 4—4 in FIG. 3.
Figure 5:
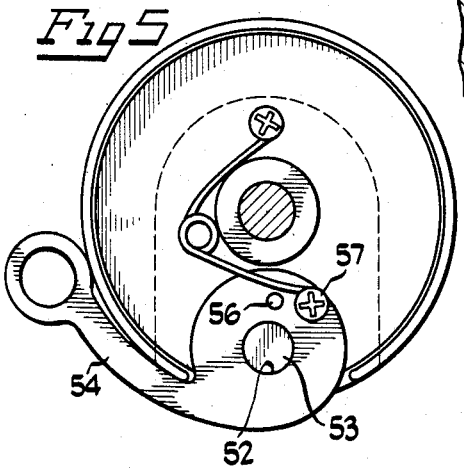
FIG. 5 is a view similar to FIG. 4, illustrating the latch assembly in the unlatching position thereof.
Figure 7:
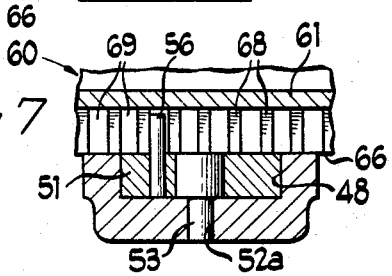
FIG. 7 is a fragmentary view in horizontal section taken along the line 7—7 in FIG. 4.

Carried by the mounting portion 51 inboard of the pivot pin 53 is a latch pin 56 which projects from the inner surface of the mounting portion 51 substantially parallel to the stub shaft 33. Also carried by the mounting portion 51 and projecting therefrom substantially parallel to the latch pin 56 is a short stud 57, to which is connected one leaf 58 of an over-center torsion spring 59, the other leaf **58*a* of which is secured to the stud 49, so that the leafs 58 and 58*a* straddle the hub portion 42 of the end cap 40, as best illustrated in FIGS. 4 and 5. Spacers 59*a* (FIG. 2) may be utilized to provide the proper offset from the bearing face 41**.

The latch arm 50 is pivotally movable between an unlatching position, illustrated in FIG. 5, wherein the actuator handle 54 lies along the outer edge of the end cap 40 generally coaxially therewith, and a latching position, illustrated in FIGS. 3, 4, 6 and 7, wherein the actuator handle 54 engages the other edge of the recess 48 and projects generally radially outwardly from the end cap 40. The configuration of the spring 59 is such that it tends to resiliently urge the latch arm 50 into whichever one of these two positions it happens to be in, thereby inhibiting movement from either position. More specifically, movement of the latch arm 50 from either of its latching or unlatching positions must initially tend to compress the spring leafs 58 and **58*a* toward each other against the resilient biasing action of the spring 59**.

Figure 2:
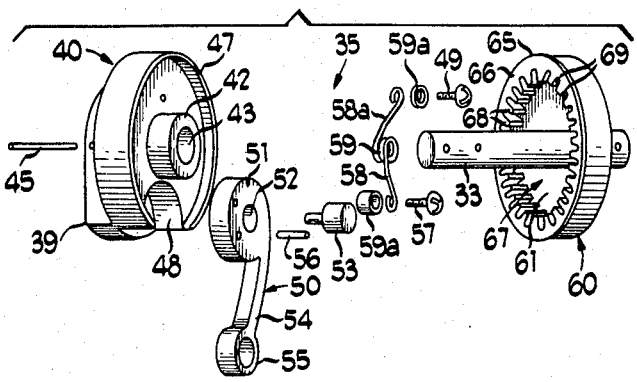
FIG. 2 is an enlarged, exploded, perspective view of one of the latch assemblies of FIG. 1.
Figure 3:
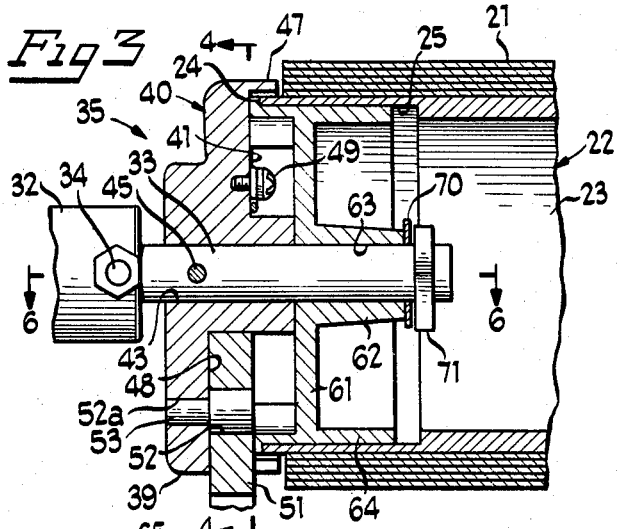
FIG. 3 is a further enlarged fragmentary view in vertical section taken along the line 3—3 in FIG. 1, illustrating one of the latch assemblies of the present invention in its latching position.
Figure 6:
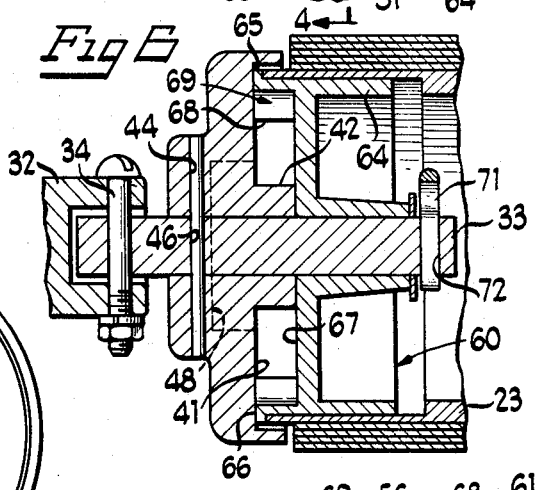
FIG. 6 is a fragmentary view in horizontal section taken along the line 6—6 in FIG. 3.

The latch assembly 35 also includes a circular end plate 60 which is fixedly secured to the adjacent end of the roller 22 for rotation therewith. More specifically, the end plate 60 includes a circular web 61 having a cylindrical hub 62 projecting axially from one side thereof centrally thereof. A cylindrical bore 63 is formed through the web 61 and the hub 62 for receiving the associated stub shaft 33, the parts being dimensioned so that the end plate 60 is freely rotatable on the stub shaft 33. Integral with the web 61 at its outer periphery and projecting axially therefrom in both directions is a cylindrical outer wall 64, provided at one end thereof with a short radially outwardly extending flange 65 (FIGS. 2 and 6). In use, the cylindrical wall 64 is dimensioned to fit coaxially into the counterbored cylindrical surface 25 of the roller 22, with the flange 65 abutting the end face 24, as is best shown in FIGS. 3 and 6. The end plate 60 may be secured in place on the roller 22 by any suitable means (not shown).

The cylindrical outer wall 64 is substantially thicker at the outer, flanged end thereof than at the inner end thereof, and terminates in an outer annular end face 66, the cylindrical outer wall 64 cooperating with the web 61 to define a cylindrical cavity 67 at the outer end of the end plate 60. The inner cylindrical surface of the cylindrical outer wall 64 is fluted or scalloped to define a plurality of equiangularly spaced-apart, and radially inwardly extending detents 68 alternating with radially extending keeper recesses or pockets 69 which communicate with the cavity 67. The keeper recesses 69 are dimensioned to just receive the latch pin 56 therein with minimal clearance, the parts preferably being dimensioned so that there are at least 20 of the keeper recesses 69. In a constructional model of the invention there are 30 such recesses 69.

Referring in particular to FIGS. 3 and 6, the parts of the latch assembly 35 are so dimensioned and arranged that, in use, the end face 66 of the end plate 60 is disposed in back-to-back abutting relationship with the bearing face 41 of the end cap 40, with the flange 65 on the end plate 60 and the adjacent end of the roller 22 being received within the cylindrical flange 47. In this arrangement, it will be seen that the hub portion 42 of the end cap 40, the studs 49 and 57, the spring 59 and the latch pin 56 all project into the cavity 67 in the end plate 60. In this regard, the inner end of the stub shaft 33 projects a slight distance inwardly beyond the inner end of the hub 62 and is coupled to the end plate 60 by a washer 70 received over the inner end of the stub shaft 33 and a cotter pin 71 extending through a complementary radial bore 72 through the stub shaft 33, as illustrated in FIGS. 3 and 6. The parts are positioned so that the inner end of the hub portion 42 is held seated against the web 61 of the end plate 60. When the latch arm 50 is disposed in its unlatching position, the latch pin 56 is disposed relatively close to the hub portion 42, so as to be spaced radially well inwardly from the inner ends of the detents 68 and out of their path as they rotate with the roller 22.

In use, when it is desired to lock the roller 22 against rotation, such as when the awning assembly 20 is in either its stowed or its unfurled use position, the latch arm 50 is pivoted to its latching position. This swings the latch pin 56 generally in a radially outward direction toward the periphery of the end cap 40, and into one of the keeper recesses 69. It can be seen that when the latch pin 56 is seated in a keeper recess 69, it cooperates with the adjacent detents 68 effectively to prevent rotation of the end plate 60 and, therefore, the roller 22, with respect to the fixed end cap 40. When it is desired to release the roller 22, so that the awning assembly 20 can be moved between its stowed and use positions, the latch arm 50 is simply pivoted back to its unlatching position.

It is a significant advantage of the present invention that the roller 22 can be latched and unlatched with a simple single movement of the latch arm 50. Furthermore, it will be appreciated that the eye portion 55 of the latch arm 50 facilitates operation of the latch arm 50 from the ground, such as with the use of a window-pole type device (not shown) which may have a short stud designed to fit into the eye portion 55. Thus, the latch assembly 35 is very easy to operate and the over-center spring 59 affords a firm positive action which inhibits accidental movement of the latch arm 50 and, in the latching position of the latch arm 50, securely locks the roller 22 against rotation.

From the foregoing, it can be seen that there has been provided an improved latch assembly which is of simple and economical construction and is characterized by ease of operation without the use of tools.

I claim:

1. In an awning for a travel trailer or mobile home including a flexible awning covering wound on a roller which is rotatable on a fixed shaft carried by a supporting frame, the improvement comprising: a first member fixedly secured to the shaft, a second member carried by the roller for rotation therewith adjacent to said first member and having a cylindrical wall portion coaxial with said shaft, said first member and said cylindrical wall portion cooperating in use to define an annular cavity therebetween, said cylindrical wall portion having a plurality of keeper recesses therein formed between inwardly extending detents, said recesses communicating with said annular cavity, and a latch member carried by said first member and projecting into said cavity parallel to said axis for movement between a latching position disposed in the path of said keeper recesses and an unlatching position out of the path of said keeper recesses, said latch member in the latching position thereof being engageable in a selected one of said keeper recesses for inhibiting rotation of said second member and the roller said latch member further comprising a grasping means extending outside said annular cavity.

2. The awning of claim 1, wherein said latch member is at all times disposed in said cavity or in one of said keeper recesses.

3. The awning of claim 1, and further including bias means resiliently inhibiting movement of said latch member from the latching and unlatching positions thereof.

4. Latch apparatus for a roller mounted for rotation about a fixed shaft, said latch apparatus comprising: a fixed shaft, a first member fixedly secured to the shaft, a second member carried by the roller for rotation therewith adjacent to said first member and having a cylindrical wall portion coaxial with said shaft, said first member and said cylindrical wall portion cooperating in use to define an annular cavity therebetween, a plurality of equiangularly spaced-apart detents integral with said wall portion and extending radially inwardly therefrom with the spaces between said detents defining radial pockets communicating with said annular cavity, a latch arm carried by said first member and projecting outwardly from said cavity for pivotal movement between a latching position and an unlatching position about an axis disposed substantially parallel to the shaft and displaced therefrom, a latch member carried by said latch arm and projecting therefrom substantially parallel to said axis into said cavity, said latch member in the unlatching position of said latch arm being disposed radially inwardly of the inner ends of said detents for accommodating free rotation of the roller, movement of said latch arm from the unlatching position to the latching position thereof effecting movement of said latch member into one of said pockets for cooperation with the adjacent detents to inhibit rotation of the roller.

5. The latch apparatus of claim 4, wherein said second member comprises an end plate closing the roller at one end thereof.

6. The latch apparatus of claim 5, wherein said first and second members are respectively provided with end surfaces disposed in use in facing relationship with each other.

7. The latch apparatus of claim 4, wherein each of said first and second members has an axial bore receiving the shaft therethrough.

8. The latch apparatus of claim 7, and further including coupling means extending radially of the shaft for fixedly securing said first member thereto.

9. The latch apparatus of claim 4, and further including bias means resiliently inhibiting movement of said latch arm from the latching and unlatching positions thereof.

10. The latch apparatus of claim 9, wherein said bias means includes an over-center spring.

11. The latch apparatus of claim 4, wherein said pockets and said latch member are dimensioned so that said latch member is receivable in any one of said pockets in closely fitting relationship therewith, thereby substantially to prevent rotation of the roller.

12. The latch apparatus of claim 11, wherein the number of said pockets is greater than 20.

* * * * *